US005459947A

United States Patent [19]

Lasher

[11] Patent Number: 5,459,947

[45] Date of Patent: Oct. 24, 1995

[54] DECORATIVE SHOE TONGUE SIMULATING AND LACE SECURING DEVICE

[76] Inventor: Charles M. Lasher, 1276 Manor Dr. S., Ft. Lauderdale, Fla. 33326

[21] Appl. No.: 232,864

[22] Filed: Apr. 25, 1994

Related U.S. Application Data

[63] Continuation-in-part of Ser. No. 35,671, Mar. 23, 1993, abandoned.

[51] Int. Cl.[6] ..... A43B 23/26; A43B 23/00

[52] U.S. Cl. ..... 36/54; 36/136; 36/72 R; 36/50.1; 24/306

[58] Field of Search ..... 36/1, 50.1, 54, 36/72 R, 96, 132, 136; 24/712.1, 712.3, 306

[56] References Cited

U.S. PATENT DOCUMENTS

| | | | |
|---|---|---|---|
| D. 271,157 | 11/1983 | Gamm . | |
| D. 283,556 | 4/1986 | Campbell . | |
| D. 311,446 | 10/1990 | Merritt . | |
| 2,632,260 | 3/1953 | Herceg | 36/54 |
| 3,006,086 | 10/1961 | Bird, Jr. | 36/72 R |
| 3,601,909 | 8/1971 | Amendola | 36/54 |
| 3,906,646 | 9/1975 | Milotic . | |
| 4,069,559 | 1/1978 | Alegria . | |
| 4,080,745 | 3/1978 | Torrance . | |
| 4,126,951 | 11/1978 | Antonious | 36/54 |
| 4,254,566 | 3/1981 | Haskell . | |
| 4,258,456 | 3/1981 | Thurston et al. . | |
| 4,270,285 | 6/1981 | Antonious | 36/50.1 |
| 4,275,513 | 6/1981 | Antonious | 36/50.1 |
| 4,291,439 | 9/1981 | Riti | 24/306 |
| 4,377,913 | 3/1983 | Stone | 36/54 |
| 4,428,101 | 1/1984 | Harkavy | 24/306 |
| 4,536,975 | 8/1985 | Harrell | 36/136 |
| 4,627,110 | 12/1986 | Tengs | 2/244 |
| 4,630,383 | 12/1986 | Gamm | 36/136 |
| 4,697,362 | 10/1987 | Wasserman . | |
| 4,805,321 | 2/1989 | Tonkel | 36/54 |
| 4,823,426 | 4/1989 | Bragga | 36/136 |
| 4,852,276 | 8/1989 | Savoca et al. . | |
| 4,879,787 | 11/1989 | Walls | 24/306 |
| 5,209,000 | 5/1993 | Rowland et al. | 36/136 |

FOREIGN PATENT DOCUMENTS

| | | |
|---|---|---|
| 2499375 | 8/1982 | France . |
| 2541566 | 8/1984 | France . |

OTHER PUBLICATIONS

*Boot and Shoe Recorder,* Sep. 1, 1965, p. 63.

*Primary Examiner*—Paul T. Sewell
*Assistant Examiner*—Marie Denise Patterson
*Attorney, Agent, or Firm*—Sara L. Vinas; Jerry A. Miller

[57] ABSTRACT

A decorative attachment for a lace-up type shoe which simulates a fold-down shoe tongue. A tongue simulating portion, having a top surface and a bottom surface, a top end and a bottom end, substantially covers a lace and knot portion of the shoe. The tongue simulating portion is preferably tapered to be narrower at the bottom end than at the top end. A decorative indicia is silkscreened to the top surface of the tongue simulating portion, and preferably represents a foot of a mascot for an athletic team. A strap extends from the end of the tongue simulating portion and is folded under the laces of the shoe. The strap has an upper surface which lies adjacent the lower surface of the tongue simulating portion when the strap is folded under the laces of the shoe and sandwiches the laces between the bottom surface of the tongue simulating portion and the upper surface of the strap. The tongue simulating portion and the strap are cut from a single sheet of leather, canvas or plastic material. A hook and loop fastening system having first and second parts which mate with each other has the first part attached to the bottom surface of the tongue simulating portion. The second part is attached to the upper surface of the strap. The first and second parts of the hook and loop fastening system are located in a position such that a knot in the shoe laces is encircled by the hook and loop fastening system when the decorative attachment is secured in place.

9 Claims, 2 Drawing Sheets

DECORATIVE SHOE TONGUE SIMULATING AND LACE SECURING DEVICE

This is a continuation-in-part of copending application Ser. No. 08/035,671 filed on Mar. 23, 1993, now abandoned, which is hereby incorporated by reference.

COPYRIGHT NOTICE

A portion of the disclosure of this patent document contains material which is subject to copyright protection. The copyright owner has no objection to the facsimile reproduction of the patent document or the patent disclosure, as it appears in the Patent and Trademark Office patent file or records, but otherwise reserves all copyright rights whatsoever.

BACKGROUND

1. Field of the Invention

This invention relates generally to the field of shoe accessories. More particularly, this invention relates to a decorative removable fold-down shoe tongue simulator which can be worn with any lace-up shoe (and many buckle-up or strap-on shoes) which additionally secures the shoelace knot.

2. Background of the Invention

Many sports fans enjoy supporting their favorite sports teams by wearing clothing decorated with the team's logo, team's mascot, etc. Shoes are commercially available which depict such logos for various teams. However, if a sports fan wishes to display more than one team's logo, then a corresponding number of pairs of shoes are required. Similarly, a sports fan who wishes to display the team logo with differing styles of shoes would require a corresponding number of shoes having the team logo. This, of course, can be costly, especially if one wishes to have the option of not displaying such logos when inappropriate. In the case of children, it can be especially costly to have several pairs of shoes depicting several different teams, since shoes are often rapidly outgrown during childhood.

It is therefore desirable to provide a device which can be used to carry a logo, advertisement or other indicia, which when attached to a shoe, appears to be the tongue of the shoe (e.g. in the style of a golf or bowling shoe in which the tongue folds down and covers the laces of the shoe—hereinafter referred to as a fold-down tongue or shawl tongue). The device can then be worn with any number of different shoes. Especially in the case of children's shoes, it is also advantageous for such a device to help secure the knot of the shoe laces to prevent them from becoming untied and tripping the wearer.

Antonious U.S. Pat. No. 4,126,951 describes a shoe having fold-down tongue of the type simulated by the present invention. Such a fold-down tongue is referred to therein as a "shawl tongue." Some dictionary definitions of the term "shawl-tongue" would suggest that such a tongue is synonymous with a "kiltie" tongue which is a slashed tongue which folds over the instep to cover the shoe laces. However, Antonious uses the term "shawl tongue" in reference to a tongue which is not slashed. For purposes of the present application, the term "fold-down tongue" and "shawl tongue" are adopted and considered synonymous. These terms should be interpreted in a manner consistent with Antonious' use of the term "shawl" in that the tongue need not necessarily be slashed (as in a kiltie tongue). These terms are intended to embrace a tongue which folds down over the instep of a shoe and covers the shoe lace area of a shoe (or equivalent area in a shoe without laces).

As previously mentioned, athletic or other shoes having various depictions of athletic team logos are available in the marketplace. It is also known to provide a mechanism on a shoe which allows the wearer to apply a logo in a designated spot provided for this purpose. Examples of this are shown in Wasserman U.S. Pat. No. 4,697,362 and Savoca et al. U.S. Pat. No. 4,852,376. However, each of these inventions require a special dedicated shoe which is either provided with a permanent logo or provided with special features which permit application of a logo to a designated area of the shoe. U.S. Pat. No. 3,601,909 provides a decorative shoe covering, and U.S. Pat. No. 2,632,250 to Herceg shows a removable tongue for a shoe which is held in place by the shoe laces and snaps attached to the shoe. Each of these devices requires a special shoe for use of the covering, or at least modification of a shoe. These devices are obviously not as versatile as a logo carrying device which is almost universally applicable to any type of lace-up shoe (as well as some other types of shoe.

Harrell U.S. Pat. No. 4,536,975 shows a detachable pocket for carrying identification or other items. Harrell's pocket is attached to the laces of a shoe and uses two snaps affixed to a strap which runs beneath the laces. One strap holds the pocket in place covering the lower portion of the laces, while the other wraps over the top of the pocket to hold the pocket in the closed position. Unfortunately, Harrell's device is an obvious add-on to the shoe. Haskell U.S. Pat. No. 4,254,566 similarly shows a detachable identification card which is engaged with the laces of an athletic shoe. Neither of these devices provide or suggest simulation of a decorative fold-down shoe tongue.

The present invention provides a device which attaches to the laces (or straps) of a shoe and covers the laces (or straps) to simulate the look of an athletic shoe having a fold-down tongue. The present invention accomplishes this with any lace up shoe and many buckle or strap type shoes without requiring a special shoe or modification of the shoe.

SUMMARY OF THE INVENTION

It is an object of the present invention to provide a simulated shawl tongue.

It is a feature that the present invention provides a novel decorative indicia to the simulated shoe tongue.

It is an advantage that the present invention aids in assuring that the laces of a shoe do not come untied.

It is a further advantage of the present invention that no special shoe or modification to the shoe is required and the device appears to be a part of the shoe.

These and other objects, advantages and features of the invention will become apparent to those skilled in the art upon consideration of the following description of the invention.

In one embodiment of the invention, a decorative attachment for a lace-up type shoe simulates a fold-down shoe tongue. A tongue simulating portion, having a top surface, a bottom surface and an end, substantially covers a lace and knot portion of the shoe. A strap extends from the end of the tongue simulating portion and folds under the laces of the shoe. The strap has an upper surface which lies adjacent the lower surface of the tongue simulating portion when the strap is folded under the laces of the shoe and sandwiches the laces between the bottom surface of the tongue simulating portion and the upper surface of the strap. A hook and loop fastening system, having first and second parts which mate with each other, has the first part attached to the bottom surface of the tongue simulating portion, and the second part attached to the upper surface of the strap. Either the hook or loop part can be used in either position.

In a preferred embodiment of the invention, a decorative attachment for a lace-up type shoe which simulates a fold-down shoe tongue. A tongue simulating portion, having a top surface and a bottom surface, a top end and a bottom end, substantially covers a lace and knot portion of the shoe. The tongue simulating portion is preferably tapered to be narrower at the bottom end than at the top end. A decorative indicia is silkscreened to the top surface of the tongue simulating portion, and preferably represents a foot of a mascot for an athletic team. A strap extends from the end of the tongue simulating portion and is folded under the laces of the shoe. The strap has an upper surface which lies adjacent the lower surface of the shawl tongue simulating portion when the strap is folded under the laces of the shoe and sandwiches the laces between the bottom surface of the tongue simulating portion and the upper surface of the strap. The tongue simulating portion and the strap are preferably cut from a single sheet of leather, canvas or plastic material. A hook and loop fastening system having first and second parts which mate with each other has the first part attached to the bottom surface of the tongue simulating portion. The second part is attached to the upper surface of the strap. The first and second parts of the hook and loop fastening system are located in a position such that a knot in the shoe laces is encircled by the hook and loop fastening system when the decorative attachment is secured in place.

In another embodiment, a decorative attachment for a lace-up type shoe which simulates a fold-down shoe tongue includes a tongue simulating portion, having a top surface and a bottom surface and an end, for substantially covering a lace and knot portion of the shoe. A strap having an upper surface, lies adjacent the lower surface of the tongue simulating portion when the strap is attached to the tongue simulating portion. A fastening system, having first and second parts which mate with each other has the first part attached to the bottom surface of the tongue simulating portion, and the second part forms at least a portion of the upper surface of the strap.

A method for attaching a simulated tongue to a lace-up type shoe having a lace area, according to the invention, includes the steps of: threading a strap portion of the simulated tongue under the lace-up area; tying the laces to produce a knot at one end of the lace area; folding the simulated tongue at a location approximately forming a junction of the strap portion and a tongue simulating portion; and engaging a hook and loop fastening system to secure the strap portion to the tongue simulating portion while encircling the knot within said hook and loop fastening system.

The features of the invention believed to be novel are set forth with particularity in the appended claims. The invention itself however, both as to organization and method of operation, together with further objects and advantages thereof, may be best understood by reference to the following description taken in conjunction with the accompanying drawing.

DETAILED DESCRIPTION OF THE INVENTION

Figure 1:
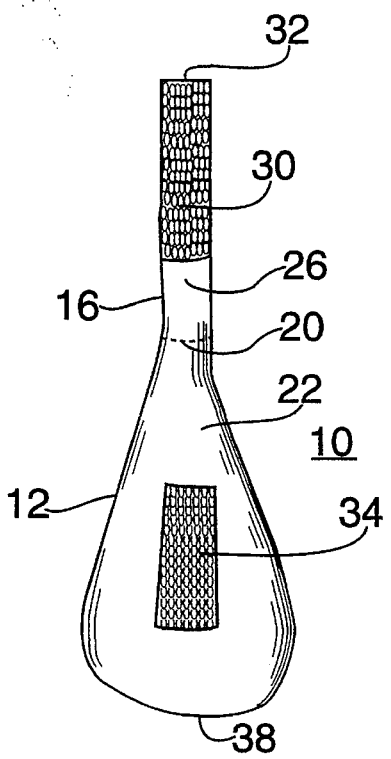
FIG. 1 is a rear view of the tongue simulating device of the present invention.

While this invention is susceptible of embodiment in many different forms, there is shown in the drawings and will herein be described in detail specific embodiments, with-the understanding that the present disclosure is to be considered as an example of the principles of the invention and not intended to limit the invention to the specific embodiments shown and described. For purposes of this disclosure, the present invention is primarily intended to simulate a shoe tongue in the style of a golf or bowling shoe tongue of the type which extends over the top side of the laces and folds down to cover the laces. This style of shoe tongue is hereinafter referred to as a fold-down tongue.

Turning now to FIG. 1, the shoe tongue simulating device of the present invention is shown generally as 10. Device 10 includes a shawl tongue simulation portion 12 and a strap 16. Both the shawl tongue simulating portion 12 and the strap 16 are punched, cut, formed, molded, or otherwise produced from a single piece of cloth, leather or plastic as a single unified part. If cloth is used, the edges are suitably bound to prevent unraveling. In use, the tongue simulating device 10 is folded approximately along a fold line 20. When folded, a bottom surface 22 of tongue simulating portion 12 is adjacent an upper surface 26 of strap 16.

A hook and loop fastening system, such as Velcro™ type hook and loop fasteners, is used to connect the strap 16 with the tongue simulating portion 12. Such hook and loop fastening systems use a first and second part which mate to one another. In FIG. 1, a strip of the first part 30 is shown as the hook part of the fastening system. A strip of this hook part is affixed to the upper surface 26 at an end 32 of strap 16 by sewing, adhesive or other suitable attachment. (In the alternate embodiment shown in FIG. 5, the strap 16 is actually made of a strip of hook or loop fastening material which is sewn or otherwise attached to the tongue simulating portion.) The mating second part 34 is similarly attached to the bottom surface 22 of the shawl tongue simulating portion 12 near, but not directly adjacent, an end 38. In FIG. 1, the mating second part 34 is shown to be the loop portion of the hook and loop fastening system. Either part of the fastening system can be located in either location as emphasized by FIG. 2 in which the hook part and loop part are reversed.

Figure 2:
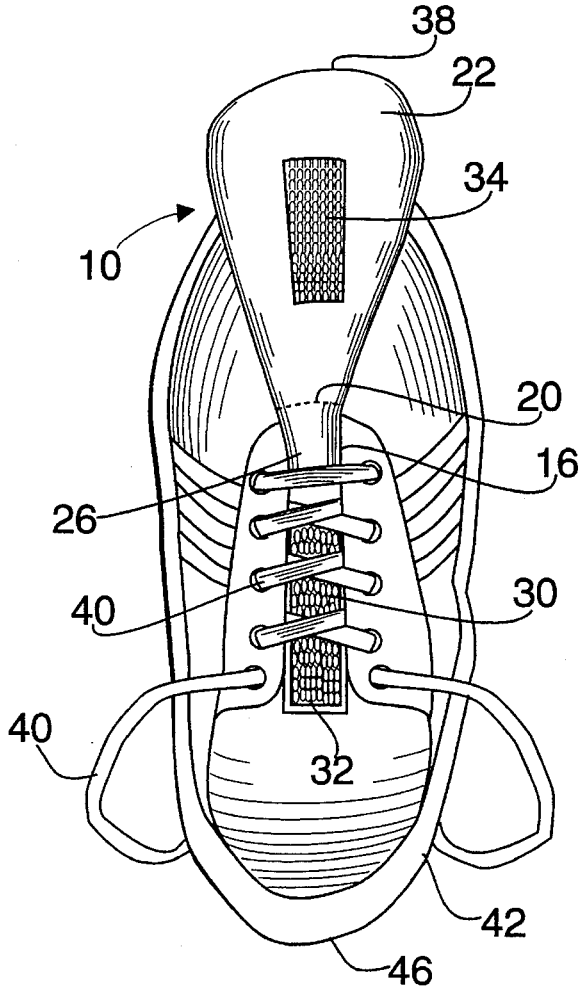
FIG. 2 is a top view of a shoe during installation of the tongue simulating device.

Referring now to FIG. 2, the tongue simulating device 10 is installed as follows. The strap 16 is inserted under the laces 40 of a lace-up type shoe 42 so that end 32 is closest to the heel 46 of the shoe. This can be done either before or after the shoe is tied, but preferably before as shown. In the preferred position of installation, the first part 30 of the fastening system is situated partially under the area where the shoe laces 40 are tied.

Figure 3:
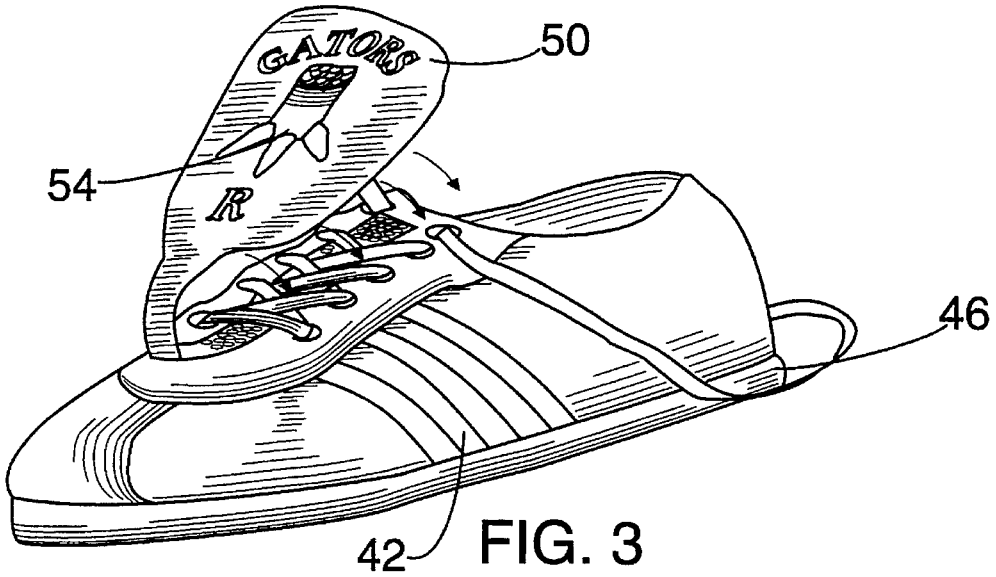
FIG. 3 is a perspective view of the shoe of FIG. 2 during the folding step of installation of the tongue simulating device.
Figure 4:
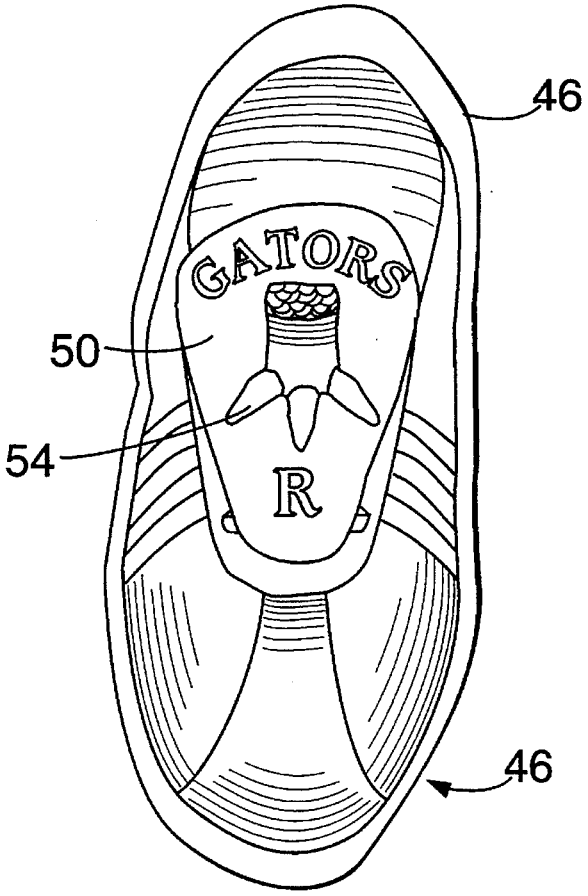
FIG. 4 is a top view of the installed tongue simulating device of the present invention.

Referring to FIG. 3, the tongue simulating device 10 is next folded along fold line 20 and pressed in the direction of the arrows to mate the first part 30 and second part 34 of the hook and loop fastening system. When this is accomplished, the top surface 50 of the tongue simulating device 10 is displayed as is shown in FIG. 4. After folding, a team logo, advertisement, slogan or other indicia 54 is displayed. Such indicia may be rendered on the top surface 50 by silkscreening or other suitable process (e.g. sewing, embroidery, painting, etc.).

In the preferred embodiment, a system of logos for teams is used. While these logos can be the team's usual logo (e.g. a mascot, team emblem, etc.), the logos are preferably in the form of the foot of a team mascot. In the example shown, the logo 54 is the foot of an alligator which accompanies the text "GATORS". Thus the theme of the mascot's foot is carried through to the foot of the user via the present footwear accessory.

The preferred fastening system for the present invention is hook and loop type fastening. This is believed to be optimal since during closure of the fastening system, the knot of the shoe laces are tightly enclosed within the first and second parts 30 and 34 of the fastening system. Hook and loop fastening systems are thus able to adapt to varying shapes of the knot due to different thickness of shoe laces, different tying styles, and normal variations in the shoe lace knots. In addition, the fastening system and installation thereof is simple and economical. However, other fastening systems may have advantages and be equivalent in special circumstances.

While this invention has been described in terms of use with a lace-up shoe, for purposes of this invention, a buckle-up or strap closed shoe is equivalent to a lace up shoe as long as the shoe straps or buckles extend from side to side to permit the strap 16 to be slipped underneath the shoe straps or buckles in the same manner as with shoe laces. It is also noted that while the strap 16 of the present invention is shown to extend from the bottom of the tongue simulating portion 12, the strap 16 could equally well come from either the top or the bottom of the tongue simulating portion 12 without departing from the present invention. The preferred taper (narrow to wide from bottom to top) is a matter of style preference to which many variations may be introduced, including the opposite taper or no taper at all. In addition, other ornamentation (e.g. tassels, fringes, bows, etc.) can be used on the tongue simulating portion 12.

Figure 5:
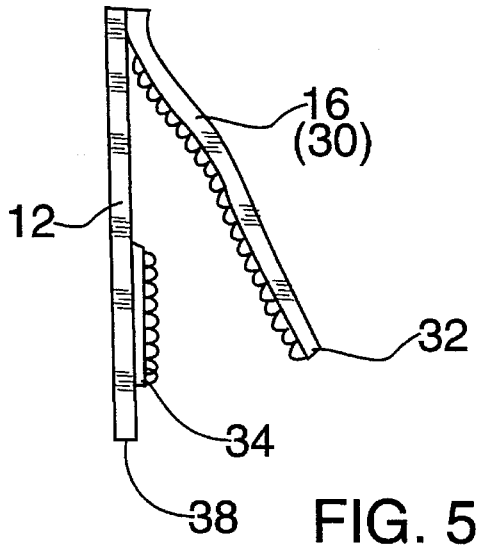
FIG. 5 is an alternative embodiment of the tongue simulating device of the present invention.

Although shawl tongue simulating portion 12 and strap 16 are preferably a single piece of fabric, leather, plastic or the like, the present device could equally well be made using a separate strap 16 which sewn or otherwise attached to the shawl tongue simulating portion 12. In this case, the strap 16 can be attached so that it normally lies parallel to the tongue simulating portion 12 and is folded to open the fastening system. This is illustrated in FIG. 5 along with another variation contemplated. In FIG. 5, the strap 16 is simply a strip of hook or loop fastener (16) which is sewn or otherwise attached to the shawl tongue simulating portion 12. In fact, strap 16 may be a loose strip of hook or loop fastener which is attached to the tongue simulating portion 12 only by means of the hook and loop fastening mechanism. In this case, the mating fastening portion 34 preferably extends substantially along the entire length of the tongue simulating portion. In other variations, the shawl tongue simulating portion 12 may also join strap 16 using a suitable hinge mechanism. Many other variations will occur to those skilled in the art.

Thus it is apparent that in accordance with the present invention, an apparatus that fully satisfies the objectives, aims and advantages is set forth above. While the invention has been described in conjunction with specific embodiments, it is evident that many alternatives, modifications, permutations and variations will become apparent to those skilled in the art in light of the foregoing description. Accordingly, it is intended that the present invention embrace all such alternatives, modifications and variations as fall within the scope of the appended claims.

What is claimed is:

1. A decorative attachment for a lace-up type shoe, wherein said shoe has a tongue and shoe laces, comprising in combination:

a shawl tongue simulating portion, having a top surface and a bottom surface, a top end and a bottom end, for substantially covering a lace and knot portion of said shoe, said shawl tongue simulating portion being tapered to be narrower at said bottom end than at said top end;

a decorative indicia silkscreened to said top surface of said tongue simulating portion, said decorative indicia representing a foot of a mascot for an athletic team a strap extending from said bottom end of said shawl tongue simulating portion for folding under the laces of said shoe, said strap having an upper surface which lies adjacent said lower surface of said shawl tongue simulating portion when said strap is folded under the laces of said shoe and sandwiches said laces between said bottom surface of said shawl tongue simulating portion and said upper surface of said strap;

hook and loop fastening means having first and second parts which mate with each other, said first part attached to said bottom surface of said shawl tongue simulating portion, said second part attached to said upper surface of said strap;

said first and second parts of said hook and loop fastening means are located in a position where the knot in said shoe laces is encircled by said hook and loop fastening means;

whereby, said shawl tongue simulating portion conceals said tongue and shoe laces to visually simulate the appearance of a shawl tongue forming an integral part of said shoe.

2. A detachable decorative attachment for a lace-up type shoe, said shoe having a shoe tongue and shoe laces including a knot area, situated in an upper front region of said shoe, said detachable decorative attachment simulating a shawl tongue, the detachable decorative attachment comprising in combination:

shawl tongue simulating portion, having a top surface and a bottom surface and a top and bottom end, for concealing said shoe tongue and shoe laces of said shoe to create an illusion that said shawl tongue simulating portion is an actual shawl tongue forming an integral part of said shoe;

wherein said shawl tongue simulating portion is tapered to be narrower at said bottom end than at said top end:

a decorative indicia applied to said top surface of said shawl tongue simulating means by silkscreening;

a folding area at said bottom end of said shawl tongue simulating portion;

a strap extending from said bottom end of said shawl tongue simulating portion for folding at said folding area under the laces of said shoe, said strap having an upper surface which lies adjacent said lower surface of said shawl tongue simulating means when said strap is folded under the laces of said shoe and sandwiches and secures said laces and knot area between said bottom surface of said shawl tongue simulating means and said upper surface of said strap to prevent accidental untying of said shoe laces;

hook and loop fastening means having first and second parts which mate with each other, said first part attached to said bottom surface of said shawl tongue simulating portion, said second part attached to said upper surface of said strap, so that only said top surface of said shawl tongue simulating portion is in clear view and said strap and said hook and loop fastening means are completely hidden from view by said shawl tongue simulating portion when said detachable decorative attachment is attached to said shoe.

3. The apparatus of claim 1, wherein said shawl tongue simulating portion and said strap are cut from a single sheet of material.

4. The apparatus of claim 2, wherein said shawl tongue simulating portion and said strap are cut from a single sheet of material.

5. The apparatus of claim 2, wherein said decorative indicia represents a foot of a mascot for an athletic team.

6. A decorative attachment for a lace-up type shoe, wherein said shoe has a tongue and shoe laces, comprising in combination:

a shawl tongue simulating portion, having a top surface and a bottom surface, a top end and a bottom end, for substantially covering a lace and knot portion of said shoe, said shawl tongue simulating portion being tapered to be narrower at said bottom end than at said top end;

a decorative indicia affixed to said top surface of said tongue simulating portion;

a strap extending from said bottom end of said shawl tongue simulating portion for folding under the laces of said shoe, said strap having an upper surface which lies adjacent said lower surface of said shawl tongue simulating portion when said strap is folded under the laces of said shoe and sandwiches said laces between said bottom surface of said shawl tongue simulating portion and said upper surface of said strap;

hook and loop fastening means having first and second parts which mate with each other, said first part attached to said bottom surface of said shawl tongue simulating portion, said second part attached to said upper surface of said strap;

said first and second parts of said hook and loop fastening means are located in a position where the knot in said shoe laces is encircled by said hook and loop fastening means;

whereby, said shawl tongue simulating portion conceals said tongue and shoe laces to visually simulate the appearance of a shawl tongue forming an integral part of said shoe.

7. The apparatus of claim 6, wherein said decorative indicia is applied to said top surface by silkscreening.

8. The apparatus of claim 6, wherein said decorative indicia represents a foot of a mascot for an athletic team.

9. The apparatus of claim 6, wherein said shawl tongue simulating portion and said strap are cut from a single sheet of material.

* * * * *